United States Patent [19]

Van Es et al.

[11] Patent Number: 4,765,800

[45] Date of Patent: Aug. 23, 1988

[54] GASOLINE COMPOSITION

[75] Inventors: Cornelis Van Es, Amsterdam, Netherlands; Richard Miles, Manley; Gautam T. Kalghatgi, Broughton; John S. McArragher, London; Rudolf F. Heldeweg, Chester, all of United Kingdom

[73] Assignee: Shell Oil Company, Houston, Tex.

[21] Appl. No.: 876,556

[22] Filed: Jun. 20, 1986

[30] Foreign Application Priority Data

Jun. 24, 1985 [GB] United Kingdom ..... 8515974

[51] Int. Cl.[4] ..... C10L 1/14

[52] U.S. Cl. ..... 44/62; 44/57; 44/64; 44/72; 252/56 D

[58] Field of Search ..... 44/62, 64, 72, 57; 252/33.2, 56 D

[56] References Cited

U.S. PATENT DOCUMENTS

| | | | |
|---|---|---|---|
| 3,231,587 | 1/1966 | Rense | 260/346.8 |
| 3,755,167 | 8/1973 | Otto et al. | 252/33.2 |
| 3,935,122 | 1/1976 | Dickert | 252/33.2 |
| 4,032,304 | 6/1977 | Dorer et al. | 44/66 |
| 4,129,508 | 12/1978 | Friihauf | 252/33.2 |
| 4,234,435 | 11/1980 | Meinhardt | 252/49 |
| 4,357,148 | 11/1982 | Graiff | 44/62 |
| 4,388,470 | 6/1983 | Fields | 549/240 |
| 4,431,430 | 2/1984 | Sung | 44/53 |
| 4,448,586 | 5/1984 | Weidig | 44/62 |
| 4,464,182 | 8/1984 | Tack et al. | 44/62 |

FOREIGN PATENT DOCUMENTS

| | | | |
|---|---|---|---|
| 0065091 | 6/1981 | Japan | 44/62 |
| 0222190 | 12/1983 | Japan | 44/62 |
| 7412057 | 9/1974 | Netherlands . | |
| 0949981 | 3/1960 | United Kingdom . | |
| 1306233 | 2/1973 | United Kingdom . | |

*Primary Examiner*—William R. Dixon, Jr.
*Assistant Examiner*—James M. Hunter, Jr.
*Attorney, Agent, or Firm*—Kimbley L. Muller

[57] ABSTRACT

Gasoline composition comprising a major amount of a gasoline suitable for use in spark-ignition engines, and a minor amount of an alkali metal or alkaline earth metal salt of a succinic acid having as substituent on at least one of its α-carbon atoms an unsubstituted or substituted aliphatic hydrocarbon group having from 20 to 200 carbon atoms, or of a succinic acid derivative having as substitutent on one of its α-carbon atoms an unsubstituted or substituted aliphatic hydrocarbon group having from 20 to 200 carbon atoms which is connected to the other α-carbon atom by means of a hydrocarbon moiety having from 1 to 6 carbon atoms.

11 Claims, No Drawings

GASOLINE COMPOSITION

FIELD OF THE INVENTION

This invention relates to a gasoline composition comprising a major amount of a gasoline suitable for use in spark-ignition engines and a minor amount of at least one additive.

In spark-ignition engines malfunctioning may occur when the gasoline/air ratio is too lean for ignition. It would therefore be advantageous if gasoline additives would be available which are capable of improving the ignition of lean gasoline/air mixtures. To establish the influence of additives on the performance of spark plugs and on the early ignition, an experimental technique has been developed to measure flame speeds inside a cylinder of a spark-ignition engine.

DESCRIPTION OF THE INVENTION

It was found that many alkali metal and alkaline earth metal compounds, either organic or inorganic, added to gasoline improved the development of an early flame and the flame speed in the cylinder. Use of such metal compounds in gasoline hence improves the combustion of lean gasoline/air mixtures and therefore improves the fuel economy without impairing the functioning of the engine and the driveability of the automobile containing the engine.

Although the above effect of such metal compounds has not been recognized, it is known that such compounds may be added to gasoline. So, from British patent specification No. 785,196 it is known that monovalent metal salts, including alkali metal salts, of e.g. alkylsalicyclic or naphthenic acids can be added to fuels, including gasoline, to prevent corrosion and clogging of filters. And from British patent specification No. 818,323 the addition of e.g. alkaline earth metal compounds to light hydrocarbon mixtures such as gasolines, is known.

It was found that alkali or alkaline earth metal salts of alkylsalicyclic acids do improve the development of an early flame in spark-ignition engines but it was also found that the inlet system of the spark-ignition engines is heavily fouled by these additives. Deposits especially accumulate in fuel induction systems of automobile spark-ignition engines, when the automobiles are driven under city driving conditions which include a stop-and-go way of driving.

It was now been found that alkali or alkaline earth metal salts of certain succinic acid derivatives do not give cause to any fouling in the engine whereas they do improve the flame speed in the cylinder. The invention therefore relates to a gasoline composition comprising a major amount of a gasoline suitable for use in spark-ignition engines and a minor amount of an alkali metal or alkaline earth metal salt of a succinic acid having as a substituent on at least one of its $\alpha$-carbon atoms an unsubstituted or substituted aliphatic hydrocarbon group having from 20 to 200 carbon atoms, or of a succinic acid salt having as a substituent on one of its $\alpha$-carbon atoms an unsubstituted or substituted hydrocarbon group having from 20 to 200 carbon atoms which is connected to the other $\alpha$ carbon atom by means of a hydrocarbon moiety having from 1 to 6 carbon atoms, forming a ring structure.

The salts of the succinic acid can be monobasic or dibasic. Since the presence of acidic groups in gasoline is undesirable, it is suitable to apply monobasic salts in which the remaining carboxylic acid group has been transformed into an amide or ester group. However, the use of dibasic salts is preferred.

Suitable metal salts include lithium, sodium, potassium, rubidium, cesium and calcium salts. The effect on the ignition of lean mixtures is greater when alkali metal salts, in particular potassium or cesium salts, are used. Since potassium is more abundant and thus cheaper, salts of this alkali metal are particularly preferred.

The nature of the substituent(s) of the succinic acid salt is of importance since it determines to a large extent the solubility of the alkali or alkaline earth metal salt in gasoline. The aliphatic hydrocarbon group is suitably derived from a polyolefin, the monomers of which have 2 to 6 carbon atoms. Thus, convenient are polyethylene, polypropylene, polybutylenes, polypentanes, polyhexenes or mixed polymers. Particularly preferred is an aliphatic hydrocarbon group which is derived from polyisobutylene.

The hydrocarbon group includes an alkyl and an alkenyl moiety. It may contain substituents. One or more hydrogen atoms may be replaced by another atoms, for example halogen, or by a non-aliphatic organic group, e.g. an (un)substituted phenyl group, a hydroxy, ether, ketone, aldehyde or ester. A very suitable substituent in the hydrocarbon group is at least one other metal succinate group, yielding a hydrocarbon group having two or more succinate moieties.

The chain length of the aliphatic hydrocarbon group is of importance, too, for the solubility of the alkali metal salts in gasoline. The group has 20 to 200 carbon atoms. When chains with less than 20 carbon atoms are used the carboxylic groups and the alkali metal ions render the molecule too polar to be properly dissolvable in gasoline, whereas chain lengths above 200 carbon atoms may cause solubility problems in gasolines of an aromatic type. To avoid any possible solubility problem the aliphatic hydrocarbon group suitably has from 35 to 150 carbon atoms. When a polyolefin is used as substituent the chain length is conveniently expressed as the number average molecular weight. The number average molecular weight of the substituent, e.g. determined by osmometry, is advantageously from 400 to 2000.

The succinic acid salt may have more than one $C_{20-200}$ aliphatic hydrocarbon group attached to one or both $\alpha$-carbon atoms. Preferably, the succinic acid has one $C_{20-200}$ aliphatic hydrocarbon group on one of its $\alpha$-carbon atoms. On the other $\alpha$-carbon atom conveniently no substituent or only a rather short hydrocarbon e.g. $C_1$–$C_6$ group is attached. The latter group can be linked with the $C_{20-200}$ hydrocarbon group, forming a ring structure.

The preparation of the substituted succinic acid salts is known in the art. In case a polyolefin is used as substituent the substituted succinic acid salt can conveniently be prepared by mixing the polyolefin, e.g. polyisobutylene, with maleic acid or maleic anhydride and passing chlorine through the mixture, yielding hydrochloric acid and polyolefin-substituted succinic acid, as described in e.g. British patent specification No. 949,981. From the acid the corresponding metal salt can easily be obtained by neutralization with e.g. metal hydroxide or carbonate.

From e.g. Netherlands patent application No. 7412057 it is known to prepare hydrocarbon-substituted succinic anhydride by reacting thermally a polyolefin with maleic anhydride. Products of the above reactions may include the Diels-Alder adducts of a polyolefin and maleic anhydride. These adducts are within the scope of the invention.

The metal salts of the substituted succinic acids show already the desired effect when they are included in the gasoline composition in a very small amount. From an economical point of view the amount thereof is as little as possible provided that the desired effect is evident. Suitably, the gasoline composition according to the invention contains from 1 to 100 ppmw of the alkali metal or alkaline earth metal in the form of the alkali metal or alkaline earth metal salt of succinic acid having the aliphatic hydrocarbon group(s) as substituent(s).

Apart from metal salts of the above-mentioned substituted succinic acids the gasoline composition may contain other additives as well. So, it can contain a lead compound as anti-knock additive. However, it is emphasized that the gasoline composition according to the invention includes both leaded and unleaded gasoline. The gasoline composition can also contain antioxidants such as phenolics, e.g. 2,6-di-tert-butylphenol, or phenylenediamines, e.g. N,N'-di-sec-butyl-p-phenylenediamine, or antiknock additives other than lead compounds.

A very suitable combination for the gasoline composition according to the present invention is described in U.S. patent specification No. 4,357,148. This additive combination comprises an oil soluble aliphatic polyamine and a hydrocarbon polymeric compound. This additive combination reduces the octane requirement increase (ORI). The ORI-reduction is associated with the prevention of deposit formation in the combustion chamber and adjacent surfaces in spark-ignition engines and/or with the removal of such deposits therefrom. Although various types of polyamines and various types of polymeric compounds can be used, it is preferred to use a polyolefin, the monomers of which have 2 to 6 carbon atoms, in combination with a $C_{20-150}$ alkyl or alkenyl group-containing polyamine. Therefore, the gasoline composition according to the present invention contains such a combination. A very advantageous species of the above polyolefin is polyisobutylene, having from 20 to 175 carbon atoms in particular polyisobutylene having from 35 to 150 carbon atoms. The polyamine used is preferably N-polyisobutylene-N',N'-dimethyl-1,3-diaminopropane. The contents of the polyolefin and of the alkyl or alkenyl group-containing polyamine in the gasoline composition according to the present invention is preferably from 100 to 1200 ppmw and from 5 to 200 ppmw, respectively.

The gasoline composition according to the invention comprises a major amount of a gasoline (base fuel) suitable for use in spark-ignition engines. This includes hydrocarbon base fuels boiling essentially in the gasoline boiling range from 30° to 230° C. These base fuels may comprise mixtures of saturated, olefinic and aromatic hydrocarbons. They can e.g. have been derived from straight-run gasoline, synthetically produced aromatic hydrocarbon mixtures, thermally or catalytically cracked hydrocarbon feedstocks, hydrocracked petroleum fractions or catalytically reformed hydrocarbons. The octane number of the base fuel is not critical and will generally be above 65. In the gasoline hydrocarbons can be replaced up to substantial amounts by alcohols, ethers, ketones, or esters.

The alkali or alkaline earth metal salts of the above-mentioned substituted succinic acids can be added separately to the gasoline or they can be blended with other additives and added to the gasoline together. A preferred method of adding these salts to gasoline is first to prepare a concentrate of these salts and then to add this concentrate in a proper amount to the gasoline.

The invention therefore further relates to a concentrate suitable for use in gasoline comprising a gasoline-compatible diluent with from 20 to 50 %wt, calculated on the diluent, of an alkali metal or alkaline earth metal salt of a succinic acid having as substituent on at least one of its α-carbon atoms an unsubstituted or substituted aliphatic hydrocarbon group having from 20 to 200 carbon atoms or of a succinic acid having as a substituent on one of its α-carbon atoms of an unsubstituted aliphatic hydrocarbon group having from 20 to 200 carbon atoms which is connected to the other α-carbon atom by means of a hydrocarbon moiety having from 1 to 6 carbon atoms, a forming a ring structure. When a polyolefin and a polyamine as defined hereinabove are desired in the gasoline composition to be used, it is preferred that the concentrate further contains from 20 to 80 %w of a polyolefin, the monomers of which have 2 to 6 carbon atoms and from 1 to 30%w of a $C_{20-150}$-alkyl or alkenyl group-containing polyamine, in which the percentages have been calculated on the diluent. Suitable gasoline-compatible diluents are hydrocarbons, like heptane, alcohols or ethers, such as methanol, ethanol, propanol, 2-butoxyethanol or methyl tert-butyl ether. Preferably the diluent is an aromatic hydrocarbon solvent such as toluene, xylene, mixtures thereof or mixtures of toluene or xylene with an alcohol. Optionally, the concentrates may contain a dehazer, particularly a polyether-type ethoxylated alkylphenol-formaldehyde resin. The dehazer, if employed, can suitably be present in the concentrate in an amount of from 0.01 to 1 % w, calculated on the diluent.

The invention will now be illustrated with reference to the following Examples.

EXAMPLE 1

To show the improved flame speed of lean mixture tests were run using a 1.3 liter Astra engine which has been modified by a windows-containing plate to provide optional access to the combustion chamber of one of the cylinders. The compression ratio for the cylinder considered in the tests was 5.8. The engine was run at 2000 rpm at nearly stoichiometric conditions. After two hours of running, the time, ΔT, taken by the flame to travel from the spark plug gap to a laser beam at a distance of 10 mm, was frequently measured and an average ΔT was determined. This technique has been described in Combustion and Flame, 49:163–169 (1983). The tests were run on unleaded gasoline without a potassium additive and on unleaded gasoline with 50, 20 and 8 ppm of potassium. The potassium was added as the dibasic salt of polyisobutylene-substituted succinic acid, in which the polyisobutylene chain has a number average molecular weight of 930, determined by osmometry. The structure of the polyisobutylene-substituted succinic acid salt in this and the following Examples was that of the Diels-Alder adduct of the polyisobutylene and succinic acid.

The results of the tests are indicated in Table I.

TABLE I

| Amount of potassium (ppmw) | Average ΔT (ms) | Improvement % |
|---|---|---|
| — | 1.59 | — |
| 50 | 1.37 | 14 |

TABLE I-continued

| Amount of potassium (ppmw) | Average ΔT (ms) | Improvement % |
|---|---|---|
| 20 | 1.45 | 9 |
| 8 | 1.46 | 8 |

EXAMPLE 2

The effect of the improved flame speed, caused by a potassium additive, on the fuel consumption is shown by the following experiments. A 2.0 liter Ford Pinto engine was run some time for conditioning. An acceleration was triggered at 1675 rpm and terminated at 2800 rpm. This was done ten times. The fuel consumed during the acclerations and the average acceleration time were measured. The procedure was carried out using three gasolines, differing in distillation ranges, characterized by the mid-points (50%-distillation temperature). The mid-points were 101°, 109° and 120° C. The additive used was the potassium salt of polyisobutylene succinic acid, in which the polyisobutylene had a number average molecular weight of 1000, in an amount of 50 ppmw potassium.

Results of experiments with and without the use of the potassium additive are shown in Table II.

TABLE II

| Fuel mid-point C.° | Fuel consumption, ml | | | Acceleration Time, s | | |
|---|---|---|---|---|---|---|
| | No additive | With additive | Change % | No additive | With additive | Change % |
| 101 | 29.3 | 26.4 | −9.8 | 10.92 | 10.50 | −3.8 |
| 109 | 29.2 | 28.0 | −4.1 | 11.30 | 10.84 | −4.1 |
| 120 | 30.1 | 28.3 | −6.0 | 12.18 | 11.26 | −7.5 |

EXAMPLE 3

A 2.0 liter 4-cylinder Ford Sierra engine was subjected for 42 hours to test cycles comprising running the engine for 2 minutes at 900 rpm at a load setting of 52 Nm. At the end of the test the inlet valves of the cylinders were removed and rated visually according to a scale comprising a set of ten photographs representing different levels of cleanliness ranging in 0.5 unit intervals from perfectly clean (10.0) to very dirty (5.5).

In the experiments a leaded gasoline was used. The additives used were: Additive I: polyisobutylene having a number average molecular weight of 650 determined by osmometry; Additive II: N-polyisobutylene-N',N'-dimethyl-1,3-diaminopropane, the polyisobutylene chain having a number average molecular weight of 750; Additive III: like additive II but with a polyisobutylene chain of a number average molecular weight of 1000; Additive V: sodium alkyl salicylate in which the linear alkyl chain has between 14 and 18 carbon atoms. Additive V: potassium polyisobutylene succinate in which the polyisobutylene chain has a number average molecular weight of 930.

In Table III the mean ratings of the four valves are given, together with the mean improvement, expressed as $$\frac{(\text{visual rating} - \text{visual rating with no additive})}{(10.0 - \text{visual rating with no additive})}$$

(It should be noted that the amounts of Additives IV and V are expressed as ppmw alkali metal).

TABLE III

| Amount of additive, ppmw | | | | | Mean rating | Mean Improvement % |
|---|---|---|---|---|---|---|
| I | II | III | IV | V | | |
| — | — | — | — | — | 7.77 | — |
| 400 | 18 | — | — | — | 8.77 | 45 |
| 400 | 18 | — | 4 | — | 8.37 | 27 |
| 400 | 18 | — | 20 | — | 7.13 | −29 |
| 400 | — | 16 | — | 4 | 9.02 | 56 |
| 400 | 18 | — | — | 20 | 9.32 | 70 |

From Table III it is apparent that the addition of Additives I and II give a better cleanliness performance which is improved by Additive V. Additive IV tends to reverse the beneficial effect of Additives I and II.

EXAMPLE 4

To assess the thermal stability of the alkali metal-containing additives 1.00 g of the additive under investigation was put into a 5 cm diameter disk, which was placed on a hot plate kept at 280° C., a temperature similar to the valve temperature of the test described in Example 3. After 20 min. the disk was removed and cooled before reweighing to determine the percentage of the contents remaining.

A washing procedure then followed to simulate the solvent action of gasoline at the inlet ports of an engine. Thereto, a mixture of b 50%w xylene and 50%w of petroleum ether (b.p. 80°–120° C.) was used to rinse the disk. The remaining deposits were weighed to determine the percentage of these deposits, calculated on the starting additive.

The results are presented in Table IV

TABLE IV

| Additive | Weight percentage after 20 min at 280° C. | Remaining deposits after rinsing |
|---|---|---|
| potassium alkylsalicylate having a $C_{14-18}$—alkyl chain | 25.1% w | 16.5% w |
| potassium-polyisobutylene succinate, having a polyisobutylene chain of 930 | 20.3% w | 0.45% w |

From the Table it is evident that the succinate additive leaves less deposits behind after exposure to 280° C. than the alkylsalicylate. Moreover, the deposits obtained from the succinate are easily rinsed off by liquid gasoline. It is thus clear that the inlet valves will be less fouled by the succinate additive than by the alkylsalicylate additive.

What we claim as our invention is:

1. A gasoline composition comprising a major amount of a gasoline suitable for use in spark-ignition engines, and from 1 to 100 ppmw of a spark-aider additive comprising an alkali metal or an alkaline earth metal succinic acid salt having α-carbon atoms and a substituent on a first one of its α-carbon atoms comprising a first unsubstituted or substituted aliphatic hydrocarbon group having at least 20 and up to 200 carbon atoms, wherein said group is connected with a second unsubstituted or substituted aliphatic hydrocarbon group having from 1 to 6 carbon atoms thereby forming a ring structure between said groups.

2. The gasoline composition of claim 1 wherein said succinic acid salt is a dibasic salt of succinic acid.

3. The gasoline composition of claim 1 wherein said alkali metal is chosen from potassium or cesium.

4. The gasoline composition of claim 1 wherein said substituted or unsubstituted aliphatic hydrocarbon group attached to said α-carbon atom is a polymer derived from an olefin having from 2 to 6 carbon atoms.

5. The gasoline composition of claim 1 wherein said substituted or unsubstituted aliphatic hydrocarbon group attached to said α-carbon atom is derived from polyisobutylene.

6. The gasoline composition of claim 1 wherein said substituted or unsubstituted aliphatic hydrocarbon group attached to said α-carbon atoms has from 35 to 150 carbon atoms.

7. The gasoline composition of claim 1 wherein said substituted aliphatic hydrocarbon group is polyolefin, the monomers of which possess from 2 to 6 carbon atoms, and wherein said substitution of said aliphatic hydrocarbon group is made by an alkyl- or alkenyl-group-containing polyamine having from 20 to 150 carbon atoms.

8. The gasoline composition of claim 7 wherein said polyolefin is polyisobutylene and wherein the alkyl group containing polyamine is N-polyisobutylene-N,N'-dimethyl-1,3-diaminopropane.

9. The gasoline composition of claim 7 wherein said polyolefin is present in a quantity of 100 to 1200 ppmww and wherein said alkenyl or alkyl group containing polyamine is present in an amount of from 5 to 200 ppmw.

10. A concentrate suitable for use as an additive to a gasoline comprising a gasoline-compatible diluent with from 20 to 50 % w, calculated on the diluent, of an additive comprising a succinic acid salt having α-carbon atoms and having as a substituent on a first one of said α-carbon atoms a first unsubstituted or substituted aliphatic hydrocarbon group having from at least 20 and up to 200 carbon atoms, wherein said group is connected with a second unsubstituted or substituted hydrocarbon group having from 1 to 6 carbon atoms thereby forming a ring structure between said groups.

11. The concentrate of claim 10 wherein said substituted aliphatic hydrocarbon group is a polyolefin, the monomers of which possess from 2 to 6 carbon atoms, and wherein said substitution of said aliphatic hydrocarbon group is made by a $C_{20}$ to $C_{150}$ alkyl- or alkenyl-group-containing polyamine, said amount of polyolefin comprising 20 to 80 wt % and said amount of polyamine comprising from 1 to 30 wt %, said percentages calculated on the basis of said diluent.

* * * * *